US005739629A

United States Patent [19]

Yun et al.

[11] Patent Number: 5,739,629

[45] Date of Patent: Apr. 14, 1998

[54] ELECTRON GUN FOR COLOR CATHODE RAY TUBE PROVIDING TWO ELECTRON BEAM CROSS OVER POINTS

[75] Inventors: Neung-yong Yun, Seoul; Hak-cheol Yang, Kyungki-do, both of Rep. of Korea

[73] Assignee: Samsung Display Devices Co., Ltd., Kyungki-do, Rep. of Korea

[21] Appl. No.: 646,892

[22] Filed: May 8, 1996

[30] Foreign Application Priority Data

Nov. 24, 1995 [KR] Rep. of Korea ..... 95-43673

[51] Int. Cl.[6] ..... H01J 29/51

[52] U.S. Cl. ..... 313/412; 313/414; 313/458

[58] Field of Search ..... 313/460, 412, 313/414, 428, 432, 439, 450, 458; 315/15, 368.15, 382, 382.1

[56] References Cited

U.S. PATENT DOCUMENTS 3,798,478 3/1974 Say ..... 313/414
5,159,240 10/1992 Chen et al. ..... 313/414
5,256,933 10/1993 Jeon ..... 313/414
5,394,053 2/1995 Yun ..... 313/412
5,608,284 3/1997 Tojyou et al. ..... 315/15

*Primary Examiner*—Sandra L. O'Shea
*Assistant Examiner*—Jay M. Patidar
*Attorney, Agent, or Firm*—Leydig, Voit & Mayer, Ltd.

[57] ABSTRACT

A double cross-over type electron gun for a color CRT is provided. The electron gun includes a triode having a cathode, a control electrode and a screen electrode, for generating and controlling an electron beam, a plurality of focus electrodes sequentially disposed adjacent to the triode, for forming at least one auxiliary lens, and a final accelerating electrode disposed adjacent to the focus electrode, for forming a main lens. The electron beam generated by the triode includes a cross-over point in front of the main lens and proximate to the auxiliary lens. At least one of the auxiliary lenses disposed upstream from the main lens is formed as a quadrupole lens so that the position of the cross-over point in the horizontal direction and that in the vertical direction are different from each other. When a dynamic focusing voltage is applied, the image quality at the periphery of a screen can be greatly improved.

4 Claims, 3 Drawing Sheets

ELECTRON GUN FOR COLOR CATHODE RAY TUBE PROVIDING TWO ELECTRON BEAM CROSS OVER POINTS

BACKGROUND OF THE INVENTION

The present invention relates to an electron gun for a color cathode ray tube (CRT), and more particularly, to a double cross-over type electron gun for a color CRT in which two cross-over points are formed in front of a main lens.

An electron gun for a color CRT, installed in a neck section thereof, is generally constituted by: a triode having a cathode, a control electrode and a screen electrode, for generating and controlling an electron beam; a plurality of focus electrodes sequentially disposed adjacent to the triode, for forming at least one auxiliary lens; and a final accelerating electrode disposed adjacent to the focus electrodes, for forming a main lens. When the necessary voltages are applied to the triode and the respective electrodes of the conventional color CRT, unipotential or bipotential electronic lenses, i.e., a pre-focusing lens, at least one auxiliary lens, and a main lens, are formed.

The electron beam emitted from the cathode of the triode is focused and accelerated via the electronic lenses, thereby landing on the screen of the CRT. The landed beam excites a fluorescent layer deposited on the screen and an image is thus formed. When the electron beam lands on the screen, the focal lengths of an electron beam passing through the center of the electronic lens and an electron beam passing through the periphery thereof become different due to a spherical aberration of the electronic lenses. This generates a halo effect on the beam spot landed on the screen, which degrades image quality.

In order to reduce the effect caused from the spherical aberration of the electronic lenses, there has been proposed a method of enlarging the electronic lenses so as to reduce the difference between the focal lengths of the electron beams passing through the center and at the periphery of the electronic lens. To enlarge the electronic lens, either the diameter of a neck section is increased to thus enlarge the electron beam passing holes of the electrode or a large electron beam passing hole is formed through which all of three electron beams pass. In doing so, however, the deflection force of a deflection yoke must become greater as the diameter of the neck section increases, which increases power consumption. Also, there is a structural limit to the enlargement of the electron beam passing hole.

To solve the above problems, a double cross-over type electron gun for a color CRT has been developed by the present inventor. In such an electron gun, the electron beam which is focused in front of a pre-focusing lens and is secondarily focused forward of a main lens, thereby forming two cross-over points. As a result, the diameter of the electron beam incident on the main lens is decreased, so that the difference between the focal lengths of the electron beams passing through the center and the periphery of the electronic lens is reduced, which in turn reduces the halo effect. That is, the effects attributable to spherical aberration of the main lens are minimized. Also, the secondary cross-over point in front of the main lens has a focusing function as a small and acute point object in an electron gun optical system, to thereby improve focus properties.

However, according to the above double cross-over type electron gun, there is proposed only a case where a predetermined focusing voltage is applied. Thus, it is difficult to prevent distortion of the electron beam spot occurring due to the deflection magnetic field of the deflection yoke and hazing generated at the screen periphery due to over-focusing of the electron beam.

SUMMARY OF THE INVENTION

To solve the above problems, it is an object of the present invention to provide a double cross-over type electron gun for a color CRT which minimizes an over-focusing at the periphery of a screen by applying a dynamic focusing voltage.

It is another object of the present invention to provide a double cross-over type electron gun for a color CRT which minimizes distortion of the electron beam at the periphery of the screen by forming a quadrupole lens.

To achieve the first object, there is provided an electron gun for a color CRT comprising: a triode having a cathode, a control electrode and a screen electrode, for generating and controlling an electron beam; a plurality of focus electrodes sequentially disposed adjacent to the triode, for forming at least one auxiliary lens; and a final accelerating electrode disposed adjacent to the focus electrode, for forming a main lens, wherein the electron beam passed through the triode crosses over in front of the main lens by the auxiliary lens, and a dynamic focusing voltage is applied to the focus electrodes in sync with a deflection voltage of a deflection yoke for deflecting the electron beam.

To achieve the second object, there is provided an electron gun for a color CRT comprising: a triode having a cathode, a control electrode and a screen electrode, for generating and controlling an electron beam; a plurality of focus electrodes sequentially disposed adjacent to the triode, for forming at least one auxiliary lens; and a final accelerating electrode disposed adjacent to the focus electrode, for forming a main lens, wherein the electron beam passed through the triode crosses over in front of the main lens by the auxiliary lens to form a cross-over point, and at least one of the auxiliary lenses in front of the main lens is formed as a quadrupole lens so that the position of the cross-over point in the horizontal direction and that in the vertical direction are different from each other.

BRIEF DESCRIPTION OF THE DRAWINGS

The above objects and advantages of the present invention will become more apparent by describing in detail a preferred embodiment thereof with reference to the attached drawings in which.

DETAILED DESCRIPTION OF THE INVENTION

Figure 1:
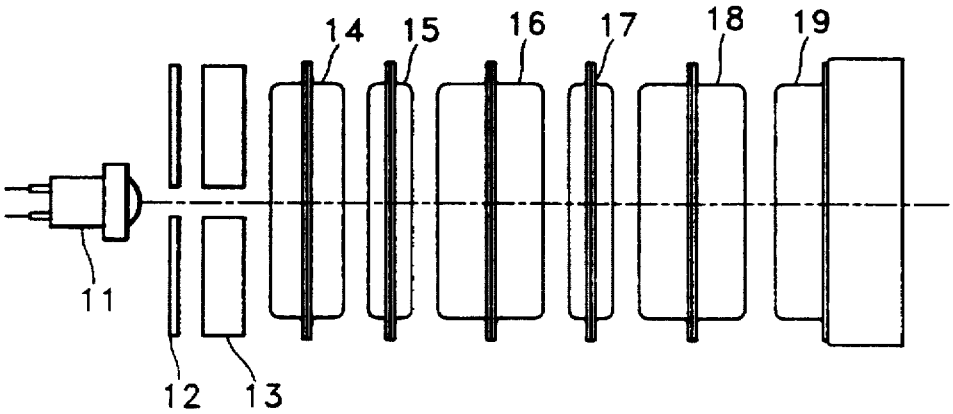
FIG. 1 is a diagram schematically showing an electron gun for a color CRT according to a preferred embodiment of the present invention.

Referring to FIG. 1, a double cross-over type electron gun for a color CRT comprises a triode having a cathode 11, a control electrode 12 and a screen electrode 13, for generating and controlling an electron beam, first to fifth focus electrodes 14, 15, 16, 17 and 18 sequentially disposed adjacent to the triode, and a final accelerating electrode 19 disposed adjacent to the fifth focus electrode 18.

In the electron gun having the above structure, when predetermined voltages are applied to the electrodes, a pre-focusing lens is formed by the screen electrode 13 and the first focus electrode 14, a unipotential first auxiliary lens is formed by the first to third focus electrodes 14, 15 and 16, and a unipotential second auxiliary lens is formed by the third to fifth focus electrodes 16, 17 and 18. Also, a bipotential main lens is formed by the fifth focus electrode 18 and the final accelerating electrode 19.

Figure 2:
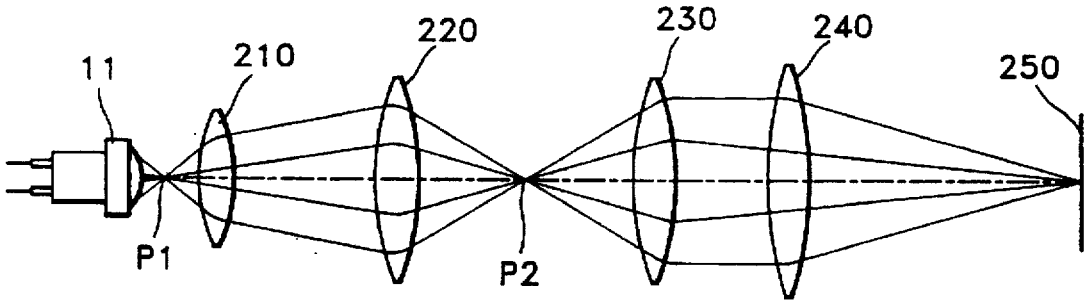
FIG. 2 is a diagram schematically showing the electronic lenses of the electron gun shown in FIG. 1 and the electron beam paths thereof.

In FIG. 2, showing the electronic lenses formed in the electron gun shown in FIG. 1 and the electron beam paths created thereby, reference numerals 210, 220, 230 and 240 denote the pre-focusing lens, first auxiliary lens, second auxiliary lens and main lens, respectively. Also, reference numeral 250 denotes a screen on which the electron beam lands. Here, the electron beam path differs from that of the conventional electron gun for a color CRT in that a second cross-over point P2 is formed in front of the second auxiliary lens 230, together with a first cross-over point P1 formed in front of the pre-focusing lens 210. Though the second cross-over point P2 is shown as being formed in front of the second auxiliary lens 230, its formation generally prior to the main lens 240 is within the scope of the present invention. For example, if the electron gun of the present invention includes only the first auxiliary lens 220 without the second auxiliary lens 230, the second cross-over point P2 should be located in front of the main lens 240.

In order to form the second cross-over point P2 before the main lens 240, the potential differences between the electrodes for forming the first auxiliary lens 220, that is, the first to third focus lenses 14, 15 and 16, should be increased and the lengths of the first and second focus electrodes 14 and 15, which are related with the focusing power of the first auxiliary lens 220, also should be increased.

In the case of forming the two auxiliary lenses as in the preferred embodiment, it is preferable that the thickness of the first auxiliary lens 220 be 3–5 times larger than the diameter of the electron beam passing hole of the second focus electrode 15 and the length of the fourth focus electrode 17 be 0.1–0.5 times the diameter of the electron beam passing hole of the second focus electrode 15.

According to the experiments of the present invention, the desirable lengths of the focus electrodes for forming the second cross-over point P2 in front of the second auxiliary lens 230 are: 2.0~3.0 mm for the first focus electrode 14, 3.0~N5.0 mm for the second focus electrode 15, 3.0~5.0 mm for the third focus electrode 16, 0.4~2.0 mm for the fourth focus electrode 17, and 10~16 mm for the fifth electrode 18. Here, the diameter of the electron beam passing hole of the second focus electrode 15 is approximately 3.9 mm.

Furthermore, as an example, to drive the electron gun, 0V is applied to the control electrode 12 and the second focus electrode 15, 700V is applied to the screen electrode 13 and the fourth focus electrode 17, and 7 kV is applied to the first, third and fifth focus electrodes 14, 16 and 18. Also, 25 kV is applied to the final accelerating electrode 19.

As described above, when the voltage is applied to each electrode after determining the length of each focus electrode, the electron beam further crosses before the second auxiliary lens 230, thereby forming the second cross-over point P2. Accordingly, the cross-section area of the electron beam incident on the main lens 240, which is preliminarily focused by the second auxiliary lens 230 via the second cross-over point P2, decreases, so that the difference between the focal lengths of the electron beams each passing through the center and the periphery of the main lens 240 is reduced, thereby decreasing the size of the electron beam spot.

On the other hand, if a dynamic voltage or a quadrupole lens is applied to the double cross-over type electron gun having the improved focusing properties, the status of the electron beam is further improved, thereby improving the quality of the image in the periphery of the screen.

Figure 3:
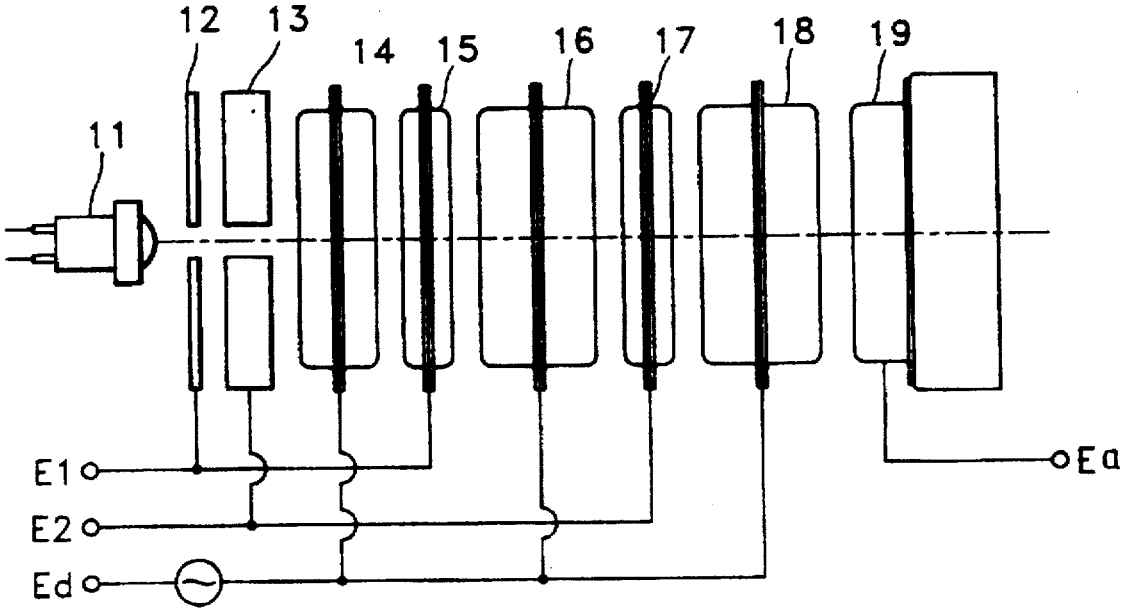
FIG. 3 is a diagram showing the state where voltages are applied to the electrodes shown in FIG. 1.

FIG. 3 schematically shows the state where voltages are applied to the electrodes of the electron gun according to the present invention. Here, reference designation E1 represents the voltage applied to the control electrode 12 and the second focus electrode 15; reference designation E2 represents the voltage applied to the screen electrode 13 and the fourth focus electrode 17; reference designation Ed represents the dynamic focusing voltage applied to the first, third and fifth focus electrodes 14, 16 and 18; and reference designation Ea represents an anode voltage applied to the final accelerating electrode 19. Here, the description of the amplitude of the voltage applied to each electrode will be omitted since the description thereto is previously provided.

Here, the dynamic focusing voltage Ed is applied in sync with the deflection voltage of a deflection yoke (not shown) for deflecting the electron beam passed through the main lens 240. As described above, when the dynamic focusing voltage Ed is applied, the intensity of the main lens 240 decreases and the focal length of the electron beam focused by the main lens 240 lengthens, thereby reducing the over-crossing phenomenon at the periphery of the screen.

Figure 4:
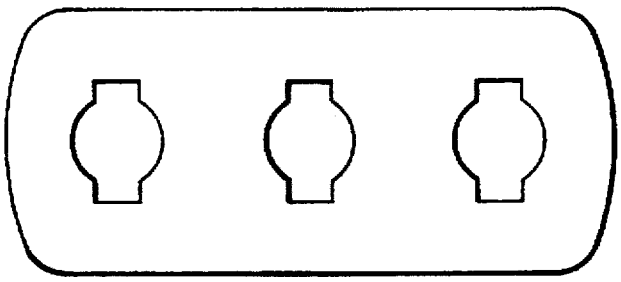
FIGS. 4 and 5 are diagrams showing the electron beam passing holes in the opposing surfaces of the second and third focus electrodes of the electron gun shown in FIG. 1.
Figure 5:
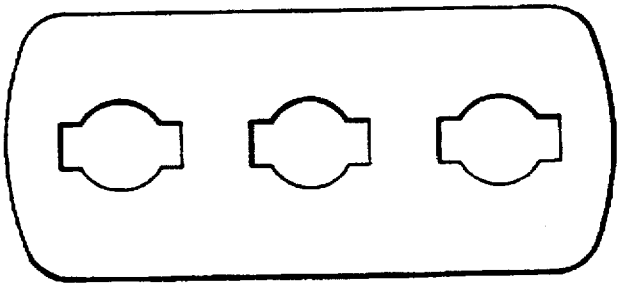

On the other hand, in order to form the first auxiliary lens 220 as a quadrupole lens, opposing surfaces of the second and third focus electrodes 15 and 16 are formed with the electron beam passing holes which are elongated vertically and horizontally, respectively, as shown in FIGS. 4 and 5. As described above, the reason of forming the first auxiliary lens 220 as a quadrupole lens is for compensating the lengthening of the beam spot's cross-section at the periphery of the screen, and particularly at the corners, by the influence of the deflection magnetic field of the deflection yoke, wherein a barrel-type magnetic field and a pin-cushion-type magnetic field are formed in the vertical and horizontal directions, respectively. That is, the focal distances in the horizontal and vertical directions of the screen are set differently from each other under the principle that the focusing intensity of the quadrupole lens is different in the vertical and horizontal directions, thereby improving the size of the beam spot at the periphery of the screen. Also, the shapes of the electron beam spots at the periphery of the screen are controlled by previously defining the cross-section of the electron beam according to the shape of the electron beam passing hole.

Figure 6:
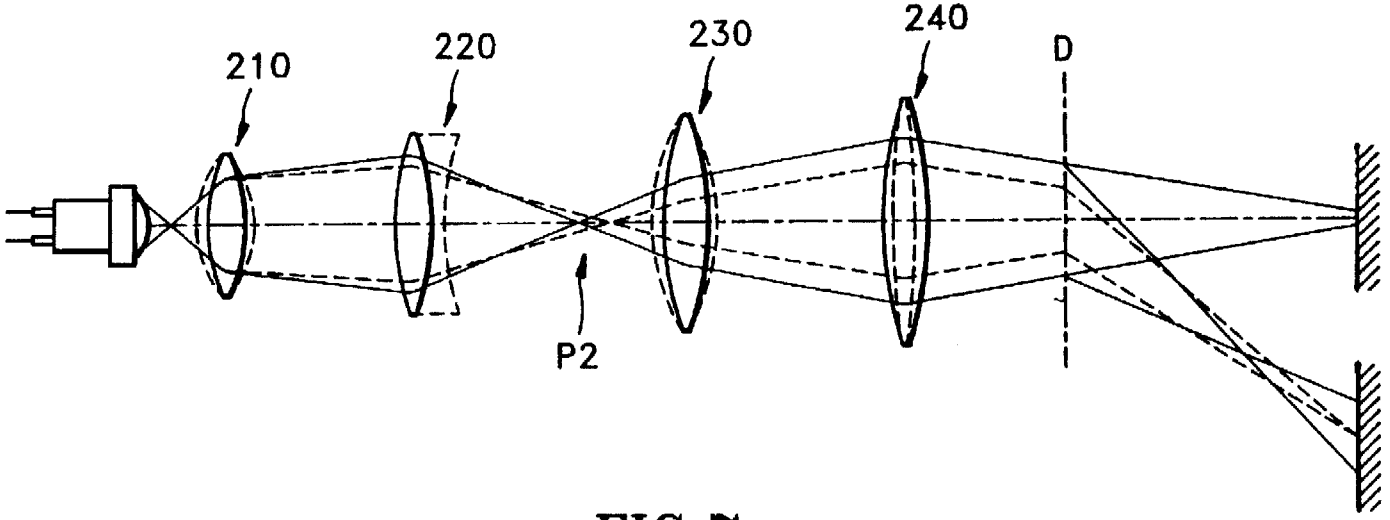
FIG. 6 is a diagram showing the electronic lenses and the electron beam path created in the electron gun in FIG. 1, viewed from the vertical section thereof.

FIG. 6 is a diagram showing the electronic lenses and the electron beam path in two states, viewed from a vertical section of the electron gun: when the dynamic focusing voltage and the quadrupole lens are both applied (dashed lines) and when neither is applied (solid lines). As known from FIG. 6, in the vertical direction of the screen, the focusing power of the pre-focusing lens 210 and the second auxiliary lens 230 become intense while that of the main lens 240 becomes weak, so that the over-focusing phenomenon at the periphery, i.e., upper or lower portion of the screen is improved. Also, diverging power of the first auxiliary lens 220 increases, so that the second cross-over point P2 is located close to the second auxiliary lens 230. Thus, the cross-sectional area of the electron beam incident on the main lens 240 decreases and the focal distance lengthens, thereby decreasing the over-focusing phenomenon. In FIG. 6, reference designation D indicates the location of the deflection yoke.

Figure 7:
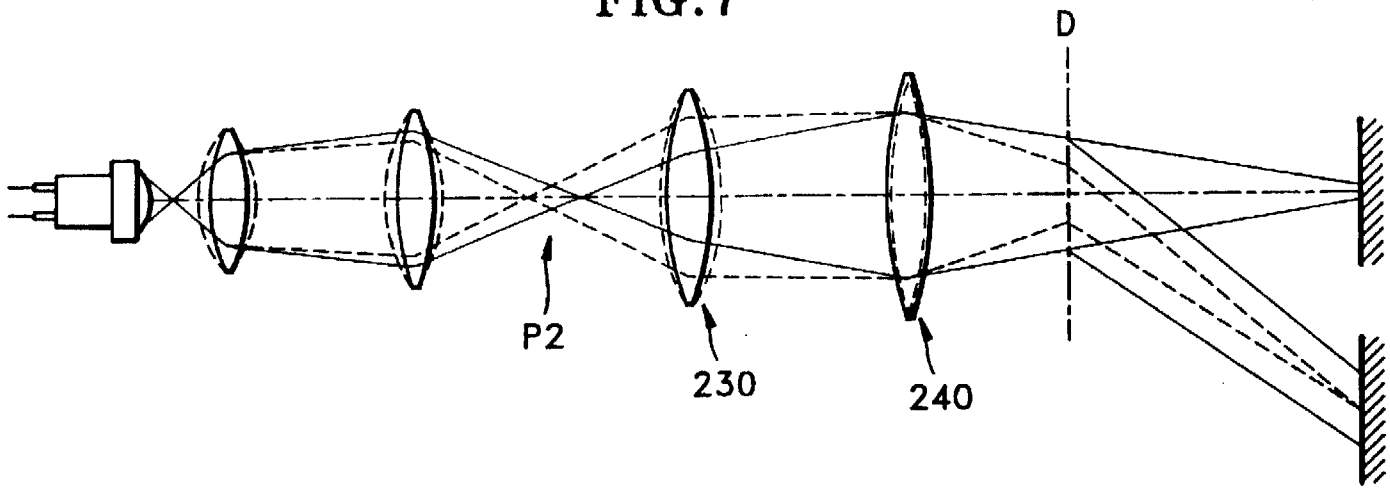
FIG. 7 is a diagram showing the electronic lenses and the electron beam paths created in the electron gun in FIG. 1, viewed from the horizontal section thereof.

FIG. 7 shows the electronic lenses and the electron beam path in two states, viewed from a horizontal section of the electron gun: when the dynamic focusing voltage and quadrupole lens are both applied (dashed lines) and when neither is applied (solid lines). As known from FIG. 7, in the horizontal direction of the screen, the second cross-over point P2 is located relatively far from the second auxiliary lens 230. As a result, the incident angle of the electron beam on the second auxiliary lens 230 increases, and accordingly the electron beam is incident on the outer periphery of the second auxiliary lens 230 and subjected to a large focusing power by the second auxiliary lens 230, so that the incident angle of the electron beam on the main lens 240 increases. Thus, the focusing power of the main lens 240 also increases, so that the shape of the electron beam spot's cross-section at the periphery of the screen is more circular.

As described above, according to the double cross-over type electron gun for the color CRT, the second cross-over point is formed in front of the main lens and a dynamic focusing voltage and/or quadrupole lens are applied, thereby minimizing the effect of spherical aberration of the lens on the electron beam spot and improving the image quality at the periphery of a screen.

What is claimed is:

1. An electron gun for a color CRT comprising:

a triode having a cathode, a control electrode, and a screen electrode, for generating and controlling an electron beam;

a plurality of focus electrodes sequentially disposed adjacent to said triode, for forming at least one auxiliary lens;

means for applying a dynamic focusing voltage to at least one of said plurality of focus electrodes, the dynamic focusing voltage being synchronized with a deflection voltage; and a final accelerating electrode disposed adjacent to said plurality of focus electrodes, for forming a main lens, wherein the electron beam generated by said triode includes a first cross over point upstream of said focus electrodes and a second cross over point upstream of the final accelerating electrode and the main lens and proximate the auxiliary lens.

2. An electron gun for a color CRT comprising:

a triode having a cathode, a control electrode and a screen electrode, for generating and controlling an electron beam;

a plurality of focus electrodes sequentially disposed adjacent to said triode, for forming at least one auxiliary lens; and a final accelerating electrode disposed adjacent to said plurality of focus electrodes, for forming a main lens, wherein the electron beam generated by said triode includes first and second cross over points respectively disposed (i) upstream of said focus electrodes and (ii) upstream of said final accelerating electrode and the main lens and proximate the auxiliary lens, the of auxiliary lens being disposed upstream of the main lens, the auxiliary lens including a quadrupole lens, the first and second cross over points being spaced from each other.

3. The electron gun for a color CRT as claimed in claim 2 further comprising means for applying a dynamic focusing voltage to at least one of the focus electrodes synchronized with a deflection voltage of a deflection yoke for deflecting the electron beam.

4. The electron gun for a color CRT as claimed in claim 2, wherein said plurality of focus electrodes includes first, second, and third focus electrodes, said second focus electrode including a surface that opposes a surface of said third focus electrode, the surface of said second focus electrode including a plurality of vertically elongated electron beam passing holes and the opposing surface of said third focus electrode including horizontally elongated electron beam passing holes.

* * * * *